US007069739B2

(12) United States Patent
Porter

(10) Patent No.: US 7,069,739 B2
(45) Date of Patent: Jul. 4, 2006

(54) DEVICE FOR COOLING OR HEATING LIQUIDS IN A BOTTLE

(76) Inventor: Michael A. Porter, 5315 Whittaker Cir., Longview, TX (US) 75605

( * ) Notice: Subject to any disclaimer, the term of this patent is extended or adjusted under 35 U.S.C. 154(b) by 0 days.

(21) Appl. No.: 10/735,072

(22) Filed: Dec. 12, 2003

(65) Prior Publication Data

US 2004/0123620 A1 Jul. 1, 2004

Related U.S. Application Data

(60) Provisional application No. 60/433,927, filed on Dec. 18, 2002.

(51) Int. Cl.
*F25D 3/08* (2006.01)

(52) U.S. Cl. ..... 62/457.3; 62/530; 62/457.2; 126/263.09; 126/262

(58) Field of Classification Search ..... 62/457.2, 62/457.3, 371, 530; 126/263.09, 262
See application file for complete search history.

(56) References Cited

U.S. PATENT DOCUMENTS

| | | | | |
|---|---|---|---|---|
| 1,897,723 | A | 2/1933 | Free | |
| 2,556,893 | A | 6/1951 | Zwiebach et al. | 62/92 |
| 2,746,265 | A | 5/1956 | Mills | 62/94 |
| 3,369,369 | A | 2/1968 | Weiss | 62/4 |
| 3,463,361 | A | 8/1969 | Cook et al. | 222/144.5 |
| 3,615,595 | A | 10/1971 | Guttag | 99/138 R |
| 4,802,343 | A | 2/1989 | Rudick et al. | 62/294 |
| 4,921,713 | A | 5/1990 | Fowler | 426/85 |
| 4,993,237 | A | 2/1991 | Bond et al. | 62/294 |
| 5,129,238 | A | 7/1992 | Schwartz et al. | 62/457.3 |
| 5,288,019 | A | 2/1994 | Gorochow | 239/33 |
| 5,507,156 | A | 4/1996 | Redmon | 62/400 |
| 5,947,378 | A | 9/1999 | Rebotier | 239/33 |
| 5,992,677 | A | 11/1999 | Ebine | 220/505 |
| 6,024,012 | A | 2/2000 | Luzenberg, Jr. | 99/323 |
| 6,103,280 | A | 8/2000 | Molzahn et al. | 426/109 |
| 6,109,538 | A | 8/2000 | Villani et al. | 239/33 |
| 6,128,906 | A | 10/2000 | Sillince | 62/4 |
| 6,141,970 | A | 11/2000 | Molzahn et al. | 62/4 |
| 6,178,753 | B1 | 1/2001 | Scudder et al. | 62/4 |
| 6,351,953 | B1 | 3/2002 | Scudder et al. | 62/4 |
| 6,494,056 | B1 | 12/2002 | Roth et al. | 62/457.3 |
| 6,564,558 | B1 | 5/2003 | Seymour | 62/4 |

*Primary Examiner*—Chen Wen Jiang
(74) *Attorney, Agent, or Firm*—John M Harrison

(57) ABSTRACT

Heat-exchanging devices for cooling or heating liquids in a bottle or can, which include in a first embodiment, an elongated cooling or heating tube having a tube bore filled with a refrigerant/heating fluid such as water and sealed at the top, with liquid flow openings provided in the tube, or in a tube connector attached to the tube above a tube seal. The tube or tube connector is fitted with a cap having internal threads for engaging the external threads of the bottle neck of the bottle into which the cooling tube is inserted. In second and third embodiments the insertable tube contains a pair of interconnected reservoirs containing liquids that will create an exothermic or endothermic reaction when mixed. A disc separating the liquids is ruptured by button action at the base of the tube to facilitate mixing of the liquids by gravity. Access to the cooled or heated liquid in the bottle is gained in each case by inverting the bottle in conventional manner to allow a flow of liquid from the bottle through the openings in the upper portion of the tube or the tube connector and into a spout provided in the cap, for drinking purposes. In a preferred embodiment a sports valve may be provided on the spout for sealing the spout against inadvertent leakage or spillage of the contents of the bottle.

14 Claims, 6 Drawing Sheets

DEVICE FOR COOLING OR HEATING LIQUIDS IN A BOTTLE

CROSS-REFERENCE TO RELATED APPLICATIONS

This application claims the benefit of and incorporates by reference copending U.S. Provisional Application Ser. No. 60/433,927, filed Dec. 18, 2002.

BACKGROUND OF THE INVENTION

SUMMARY OF THE INVENTION

This invention relates to devices for maintaining liquids contained in smooth or threaded-neck bottles and cans in a cold or warm state and more particularly, to heat-exchanging tubular devices for cooling or heating liquids in such bottles and cans. The devices include a cooling/heating tube, fitted in one embodiment with a seal near one end and containing one or more refrigerant/heating fluids such as water or an artificial liquid refrigerant, typically known as "blue ice", as well as other liquids. In one embodiment a single refrigerant or heating liquid is contained and sealed in the tube. In other embodiments a pair of separate, but connected containers create a selected exothermic or endothermic reaction and condition when mixed on demand in the tube. The upper portion of the tube, or a tube connector extending the tube above the seal in the single-liquid first embodiment, is provided with openings which are disposed below a cap to which the tube or tube connector is attached, the cap typically having internal threads for attachment to the threaded bottle neck. In each threaded cap embodiment, a central opening or spout communicates with the openings in the tube connector or tube to facilitate drinking the liquid in the bottle when the bottle containing the tube is inverted in conventional fashion. Furthermore, the typically resilient, and/or flexible internal threads in the cap are designed to removably and threadably engage the threaded bottle or can neck to facilitate extending the cooling/heating tube inside the bottle or can and in contact with the liquid contents when the cap is threaded on the bottle or can neck. In the dual-container embodiment, when the tube is seated in the bottle or can and at least partially submerged in the liquid contained in the vessel and the cap is threaded on the bottle or can neck, the contents of the bottle or can may be maintained in a cool, cold, hot or warm state, depending upon the nature and properties of the fluids in the inserted tube containers, responsive to pressing a button at the bottom of the tube to effect mixing of the liquids in the containers. The liquid in the bottle or can may then be removed for drinking by inverting the bottle or can in conventional fashion. This inversion facilitates a flow of liquid from the bottle or can through the openings in the upper portion of the cooling tube or the tube connector and through the spout in the cap, to the user. In a preferred design the cap includes a sports valve that slides on the spout for sealing the contents of the bottle or can against spillage or leakage due to inadvertent inversion or dropping of the vessel. In a third preferred embodiment, the cooling/heating tube or the dual reservoirs or containers themselves may be inserted in a pre-formed, elongated opening or sleeve molded or otherwise provided in the bottle or can and extending from the bottom thereof, and a button is pressed to rupture a membrane dividing the contents of the containers in the tube to mix the liquids and effect either an exothermic reaction or an endothermic reaction and cool or heat the contents of the bottle or can. In this design the contents of the bottle or can are poured from the spout or neck opening in conventional fashion.

BRIEF DESCRIPTION OF THE DRAWINGS

The invention will be better understood by reference to the accompanying drawings, wherein.

DESCRIPTION OF THE PREFERRED EMBODIMENTS

Figure 1:
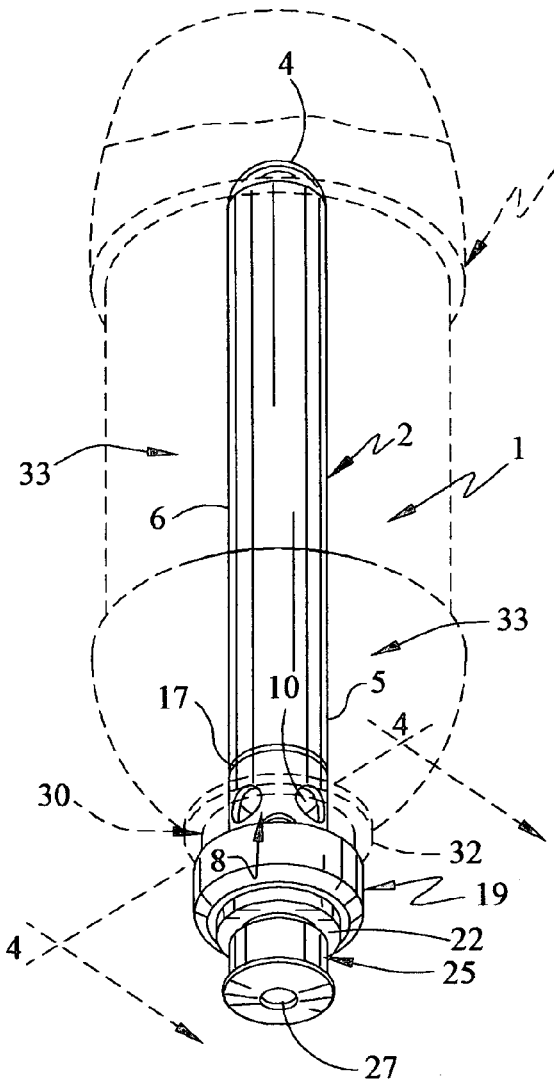
FIG. 1 is a perspective view of a first preferred embodiment of the device for cooling or heating liquids of this invention, more particularly illustrating a perforated cooling or heating tube inserted in and attached to a conventional bottle for cooling or heating and drinking a liquid contained in the bottle as the bottle and tube are oriented in an inverted position.
Figure 2:
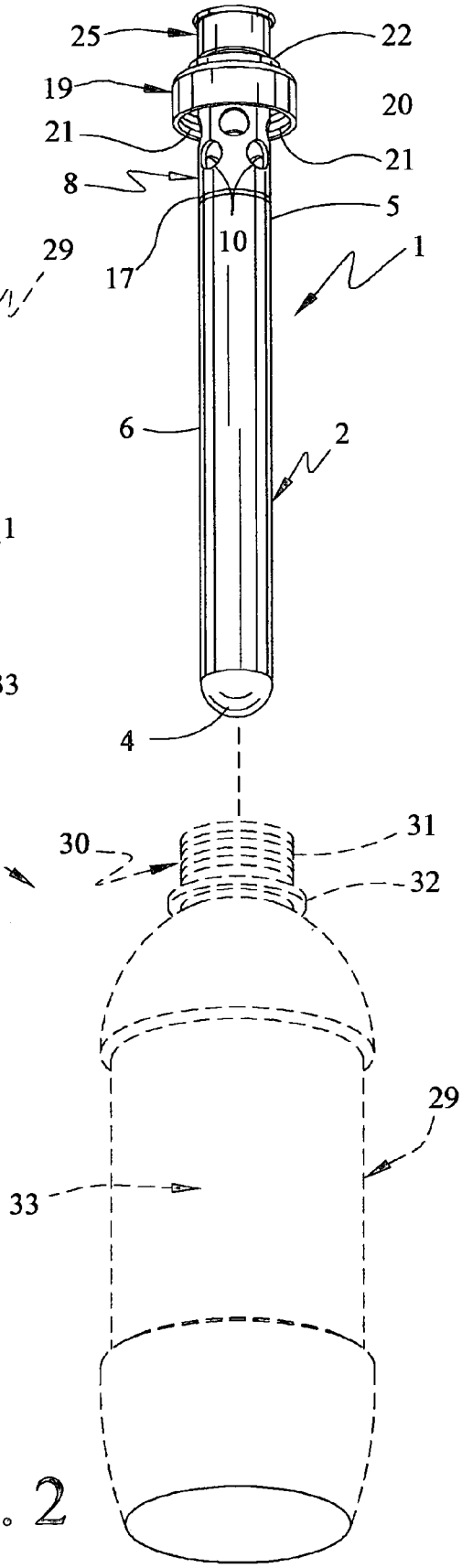
FIG. 2 is an exploded view of the first embodiment bottle and tube combination illustrated in FIG. 1, with the bottle in upright configuration and the cooling/heating tube extended from the bottle, more particularly illustrating a preferred cooling/heating tube structure.
Figure 3:
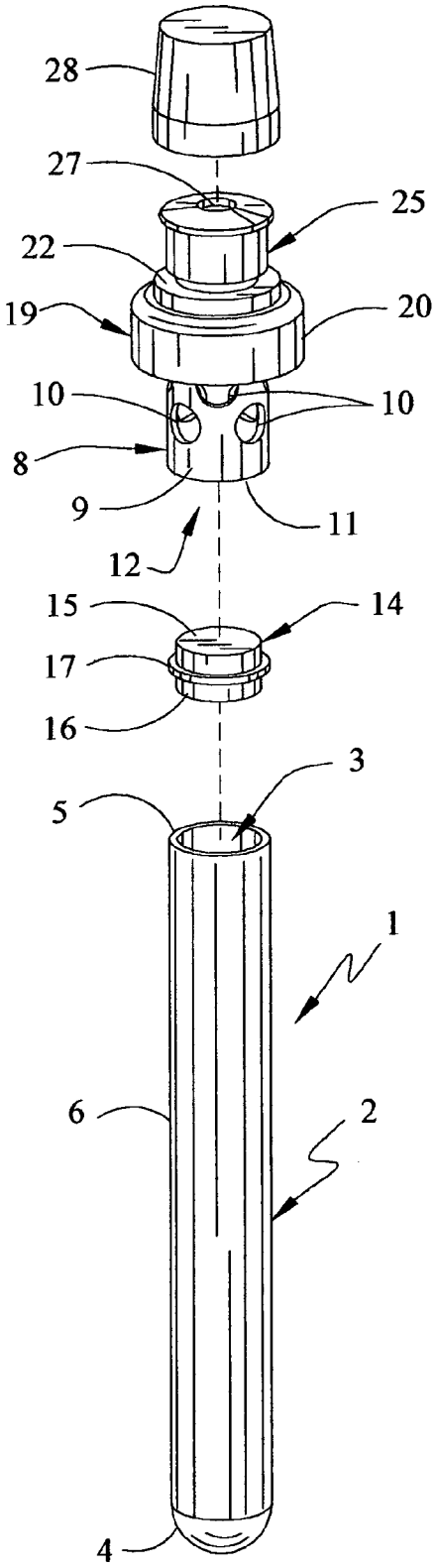
FIG. 3 is an exploded view of the cooling/heating tube illustrated in FIG. 2, more particularly illustrating the elongated cooling/heating tube, a seal joining the upper end of the tube to a tube connector fitted on an internally-threaded cap for engaging the bottle and a valve for sealing the contents of the bottle against inadvertent spillage or leakage.

Referring initially to FIGS. 1–4 of the drawings, a first preferred device for cooling or heating liquids of this invention is generally illustrated by reference numeral 1. The device 1 is designed to removably seat in a conventional bottle 29 (or a can) having a bottle neck 30, fitted with neck threads 31 and typically having a neck flange 32 (illustrated in phantom) for normally receiving a cap (not illustrated), threaded on the neck threads 31. The device 1 is further characterized by an elongated cooling/heating tube 2 which may be of sufficient length to insert inside a bottle 29 of desired height and size and become at least partially submerged in the contents. The cooling/heating tube 2 is designed to receive a refrigerant/heating (heat transfer) fluid 7 (FIG. 4), including water or an artificial fluid, gel or freezable refrigerant or ice substitute such as "blue ice" or methyl-cellulose product, and the like, in non-exclusive particular. The cooling/heating tube 2 is characterized by a cylindrical tube wall 6 that defines a tube bore 3 (FIG. 3) having a selected diameter or cross-section which is commensurate with the diameter or cross-section of the bottle 29, and is bounded by a closed bottom end 4 and an open top end 5, as illustrated in FIG. 3. The tube wall 6 is typically cylindrical and may have any desired thickness consistent with an acceptable heat transfer coefficient. However, it will be appreciated that the tube wall 6 may define an alternative configuration, as desired.

Referring again to FIGS. 2 and 3 of the drawings in this first preferred embodiment of the invention the top end 5 of the cylindrical cooling/heating tube 2 receives a tube connector 8, typically having a cylindrically-shaped connector wall 9 that corresponds in size to the diameter of the tube wall 6 of the cooling/heating tube 2, with the open connector bottom 11 of the tube connector 8 tightly fitted on the upper seal stopper 15 of a seal 14. The top end of the tube connector 8 is fixed to a cap 19, having a cap wall 20, fitted with internal cap wall threads 21 (FIG. 2). Similarly, the top end 5 of the cooling/heating tube 2 is tightly seated on the lower seal stopper 16 of the seal 14 and the connector bottom 11 and top end 5 seat tightly and hermetically against a stopper spacer 17 of larger diameter, which divides the upper seal stopper 15 and the lower seal stopper 16 of the seal 14. In this manner the tube connector 8 is removably and hermetically connected to the cooling/heating tube 2, such that the fluid contents of the cooling/heating tube 2, typically a refrigerant or heating fluid 7, (FIG. 4) located inside the tube bore 3 of the cooling/heating tube 2 cannot exit the cooling/heating tube 2. An air space 13 is typically provided in the tube bore 3 of the cooling/heating tube 2 as necessary (FIG. 4), to facilitate expansion of the refrigerant/heating fluid 7 under circumstances where the refrigerant/heating fluid 7 is water or a synthetic fluid that expands as it is heated or changes from the liquid to the frozen state.

Figure 4:
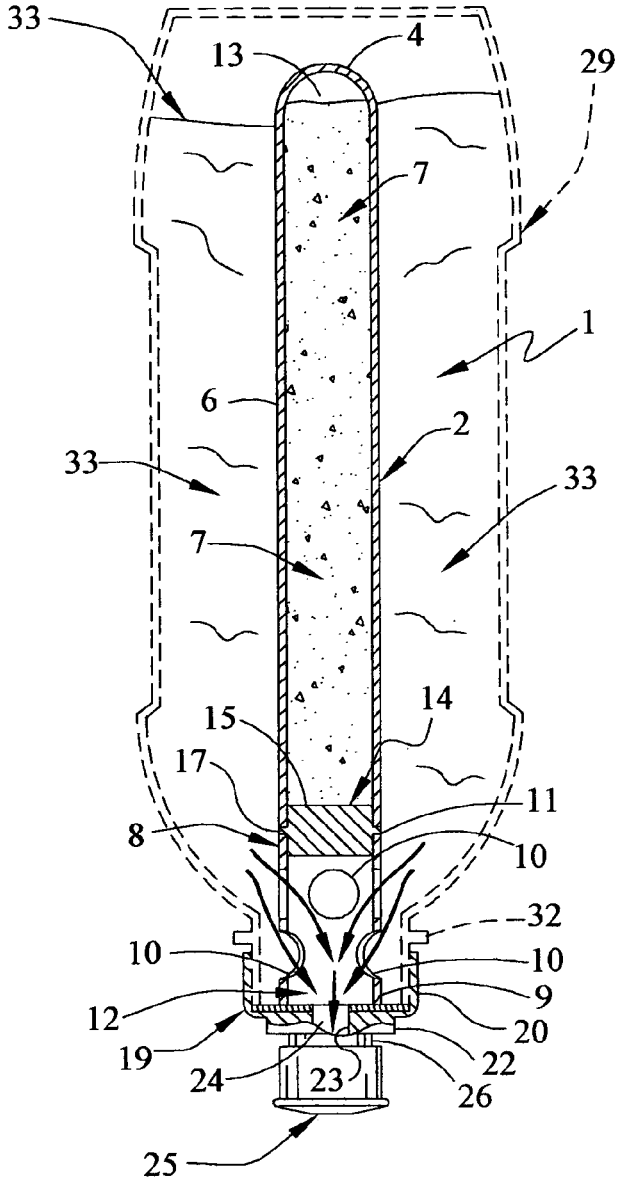
FIG. 4 is a sectional view taken along line 4—4 of the inverted first embodiment bottle and cooling/heating tube illustrated in FIG. 1, more particularly illustrating a typical flow path of liquid in the bottle through openings in the upper portion or tube connector of the cooling/heating tube and through the spout in the cap, to a user.

As further illustrated in FIGS. 3 and 4 of the drawings, a connector bore 12 is defined by the cylindrical or tubular connector wall 9 of the tube connector 8, and the connector bore 12 communicates with the spout opening or bore 24 of a spout 23, which spout opening 24 also communicates with one or more flow openings 10, provided in the connector wall 9 of the tube connector 8 (FIG. 4). Accordingly, a consumable liquid 33 contained inside the bottle 29 is able to flow downwardly in the direction of the arrows illustrated in FIG. 4, from the inverted bottle 29, through the flow openings 10 in the connector wall 9 of the tube connector 8 and subsequently, through the spout opening 24 of the spout 23, to the user.

In another preferred aspect of this embodiment of the invention, a sports valve 25 slides on a valve seat 26 of the spout 23 in the cap 19 and the sports valve 25 includes a valve opening 27, illustrated in FIG. 1, to facilitate exit of the bottle liquid 33 from the inverted bottle 29 directly into the mouth of a user. As further illustrated in FIG. 3 a valve cap or cover 28 may be seated over the valve 25 and removably attached to the cap wall shoulder 22 of the cap wall 20 in a friction-fit, to maintain the valve opening 27 free of dust and debris. Furthermore, whether or not a sports valve 25 is utilized in connection with the inverted bottle 29, the cap 19, fitted with internal cap wall threads 21 in the cap wall 20 (FIG. 2), is designed to thread on the bottle neck 30 of the bottle 29 by engagement of the cap wall threads 21 and the neck threads 31, respectively. This connection seals the cap 19 on the bottle 29 and facilitates a flow of bottle liquid 33 from the interior of the bottle 29, around the cooling/heating tube 2, through the flow openings 10 and the spout opening 24 in the spout 23 and through the valve opening 27, when the bottle 29 is inverted.

In an alternative embodiment, it will be recognized by those skilled in the art that the sports valve 25 can be removed and the spout opening 24 provided in the top of the cap 19 without a closure and with an optional valve cap or cover 28 (FIG. 3) which typically seats over the cap wall shoulder 22 in a friction-fit to removably cover the spout opening 24 against entry of dust and debris.

In yet another aspect of this first preferred embodiment of the invention the cooling/heating tube 2 can be designed with the tube connector 8 integrally formed with the cooling/heating tube 2 and the flow openings 10 provided in the upper portion of an integral tube wall 6 of selected length and shape, with a stopper or seal 14 of suitable size tightly and hermetically fitted in the tube bore 3 of the cooling tube 2 to seal the refrigerant/heating fluid 7 inside the cooling/heating tube 2 from the flow openings 10. Accordingly, the upper end of the tube 2 which is fitted with the flow openings 10 can be attached to the cap 19 such that the cap 19 and the cooling/heating tube 2 are removably threaded onto the bottle neck 30 of the bottle 29 by engaging the neck threads 31 and the corresponding internal cap wall threads 21 in the cap wall 20. This facility and design eliminates the necessity of providing a separate tube connector 8 and a specially designed seal 14, illustrated in FIG. 3 of the drawings. In this alternative design it will be further understood that a sports valve 25 may be utilized in connection with the cap 19 or may be eliminated in favor of a cap wall shoulder 22 and the provision of a removable valve cap 28 that snaps onto the cap wall shoulder 22 in a friction-fit, as described above.

The following tables illustrate the function of the device for cooling or heating liquids, as the liquid in the bottle contacts the heated, cooled or frozen device:

TABLE I 16 oz. bottle containing Gatorade out of refrigerator, with a cooling device containing ice located inside the bottle: Gatorade temperature measurements taken while bottle is in the refrigerator: Room temperature 72° F.

| Time | |
|---|---|
| 1:48 p.m. | 42.6 F (starting temperature) |
| 1:50 p.m. | 42.6 F |
| 1:52 p.m. | 42.6 F |
| 1:54 p.m. | 42.6 F |
| 1:57 p.m. | 42.8 F |
| 2:00 p.m. | 43.3 F |
| 2:05 p.m. | 44.4 F |
| 2:10 p.m. | 45.9 F |
| 2:15 p.m. | 48.0 |
| 2:20 p.m. | 49.3 F |
| 2:30 p.m. | 51.3 F |
| 2:35 p.m. | 53.1 F |
| 2:40 p.m. | 54.0 F (ending temperature) |

TABLE II 16 oz. bottle containing Gatorade; cooling device containing frozen "blue ice": Gatorade measurements taken with bottle out of refrigerator. Room temperature-72° F.

| TIME | |
|---|---|
| 1:25 p.m. | 57.7 F (starting temperature) |
| 1:29 p.m. | 52.7 F |
| 1:33 p.m. | 51.4 F |
| 1:37 p.m. | 51.4 F |
| 1:41 p.m. | 52.0 F |
| 1:45 p.m. | 52.7 F (ending temperature) |

TABLE III 24 oz. bottle containing Gatorade; cooling device containing frozen "blue ice": Gatorade measurements taken with bottle out of refrigerator and sports valve in place. Room temperature-86° F.

| TIME | |
|---|---|
| 2:28 p.m. | 50.4 F (starting temperature) |
| 2:31 p.m. | 51.1 F |
| 2:33 p.m. | 52.0 F |
| 2:35 p.m. | 53.4 F |
| 2:50 p.m. | 64.6 F |
| 2:53 p.m. | 66.2 F (ending temperature) |

TABLE IV 24 oz. bottle containing Gatorade; cooling device containing frozen "blue ice": Gatorade measurements taken at room temperature-86° F.

| TIME | |
|---|---|
| 2:56 p.m. | 67.1 F (starting temperature) |
| 2:59 p.m. | 59.2 F |
| 3:00 p.m. | 59.9 F |
| 3:18 p.m. | 69.3 F |
| 3:21 p.m. | 70.0 F (ending temperature) |

The examples illustrate the versatility and effectiveness of the device of this invention in cooling and heating liquids in bottles in the first preferred embodiment of this invention. The device 1 is simple, easy and inexpensive to construct and effective for its intended purposes.

Referring now to FIGS. 5–13 of the drawings, in a second preferred embodiment of the invention a second device for cooling or heating liquids is generally illustrated by reference numeral 40 and includes a second cooling/heating tube 41, which is designed to fit inside a conventional bottle 29, through the bottle neck 30 and into a bottle liquid 33 (illustrated in FIG. 4). The elongated second cooling/heating tube 41 encloses a top container 46, which is positioned in inverted configuration, with a top container neck 47 extending downwardly, typically into a gasket seal 64, as further illustrated in FIGS. 6, 9 and 10. The top container 46 is filled with a top container liquid 50 (FIG. 9) and is supported in the second cooling/heating tube 41 at a top container seat 49. A top container stop 48 is provided near the top of the second cooling/heating tube 41 to facilitate snugly seating the top container 46 inside the second cooling/heating tube 41, between the top container stop 48 and the top container seat 49, as illustrated. In a preferred aspect of this embodiment of the invention a typically flexible and/or resilient gasket 42 is provided on the gasket cap 43 at the top end 5 of the second cooling/heating tube 41, to facilitate threading the gasket threads 42*a* in the flexible gasket 42 on the existing conventional neck threads 31 provided on the bottle neck 30 of the bottle 29. A spout opening 44*a* is provided in a cap spout 44, shaped in the gasket cap 43 and the spout opening 44*a* communicates with the open top end 5 of the second cooling/heating tube 41 and one or more flow apertures 45, provided in the open top end 5 to facilitate pouring the consumable bottle liquid 33 from the bottle 29, through the respective flow apertures 45 and the open top end 5 and from the cap pour opening 44 when the bottle 29 is inverted for drinking purposes with the second cooling/heating tube 41 in place, as heretofore described with respect to the first preferred embodiment of the invention illustrated in FIGS. 1–4 of the drawings.

Figure 5:
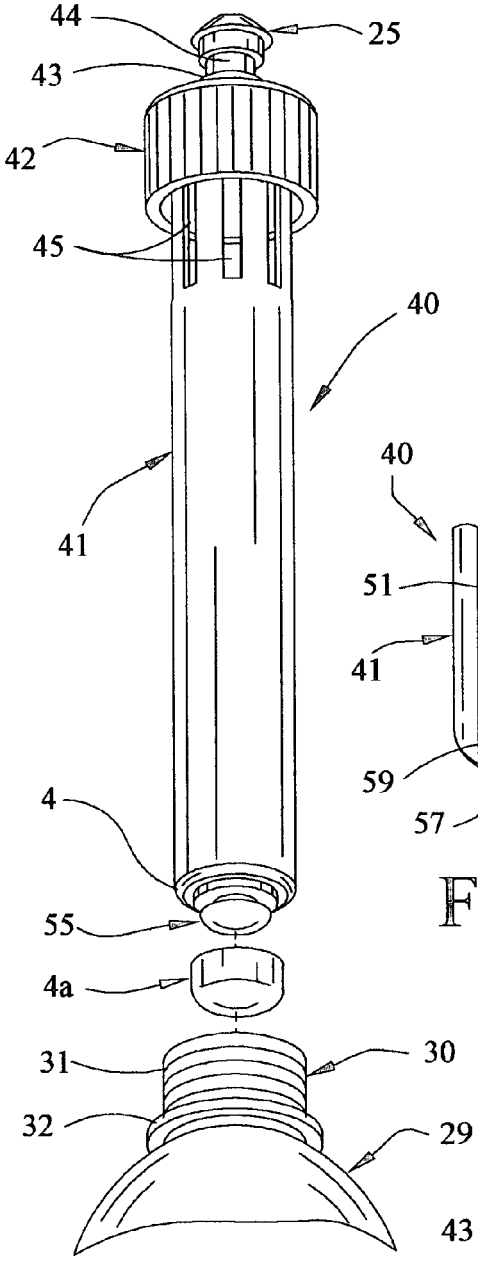
FIG. 5 is a perspective view, partially in section, of a second preferred embodiment of the cooling/heating tube of this invention, fitted with a flexible and/or resilient cap and gasket for mounting the cooling/heating tube in a bottle.
Figure 7:
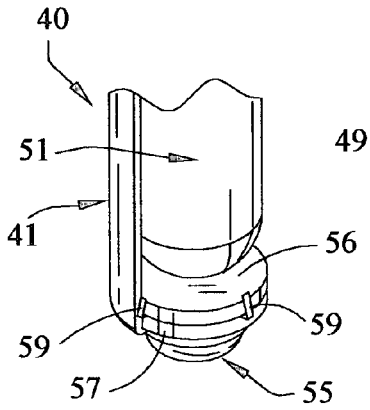
FIG. 7 is a perspective and longitudinal sectional view of the bottom end of the cooling/heating tube illustrated in FIGS. 5 and 6 , more particularly illustrating the push-button actuating element.
Figure 6:
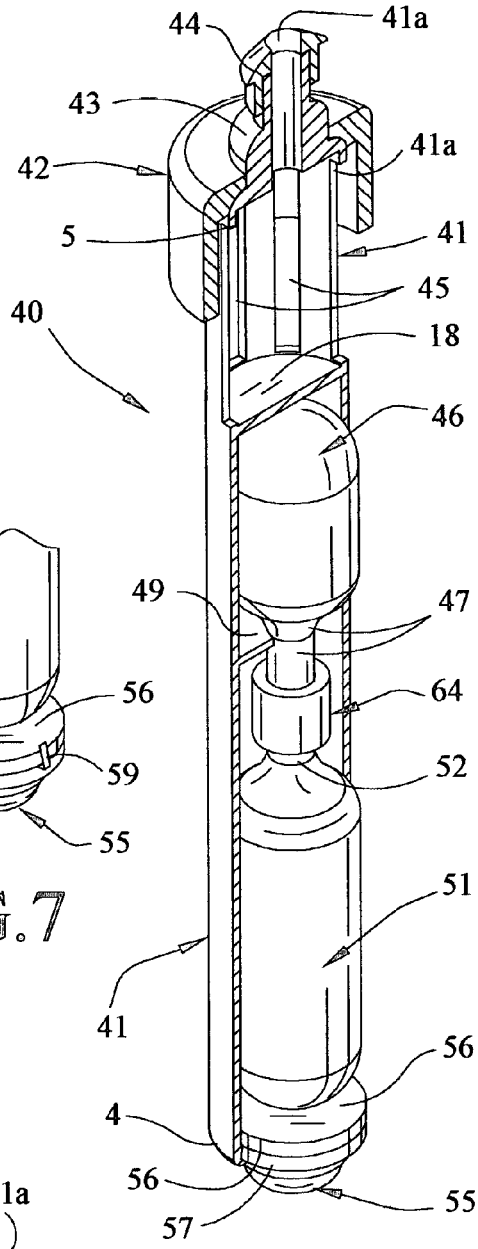
FIG. 6 is a perspective and longitudinal sectional view of the cooling/heating tube illustrated in FIG. 5.
Figure 8:
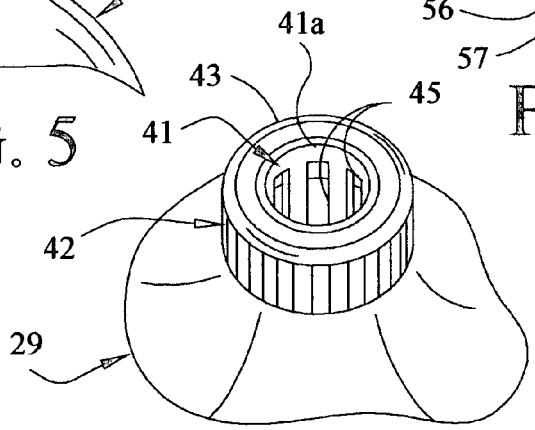
FIG. 8 is a top perspective view of an alternative cap for connecting the cooling/heating tube to a bottle or can.
Figure 9:
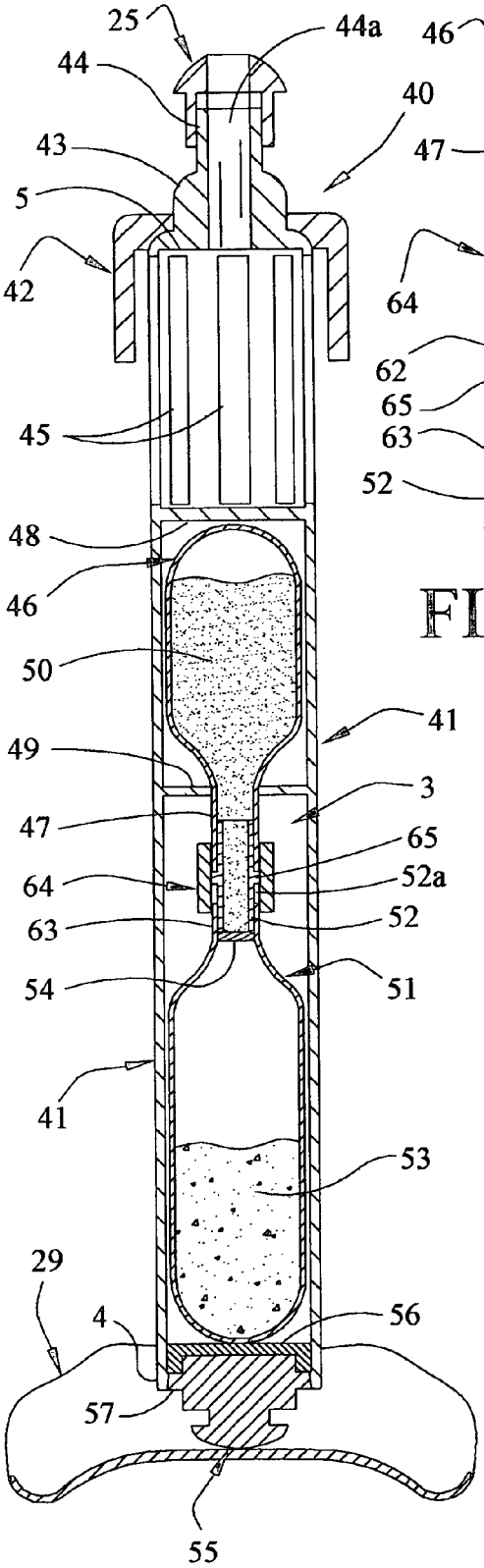
FIG. 9 is a longitudinal sectional view of the cooling/heating tube illustrated in FIGS. 5 and 6.
Figure 13:
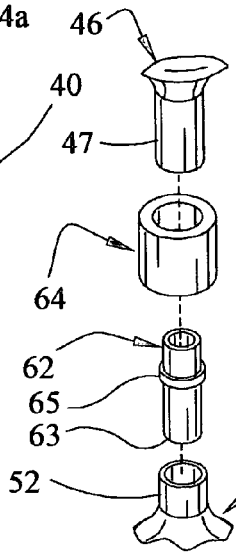
FIG. 13 is an exploded view of the straw, top container neck, gasket seal and bottom container neck configuration illustrated in FIG. 9.
Figure 10:
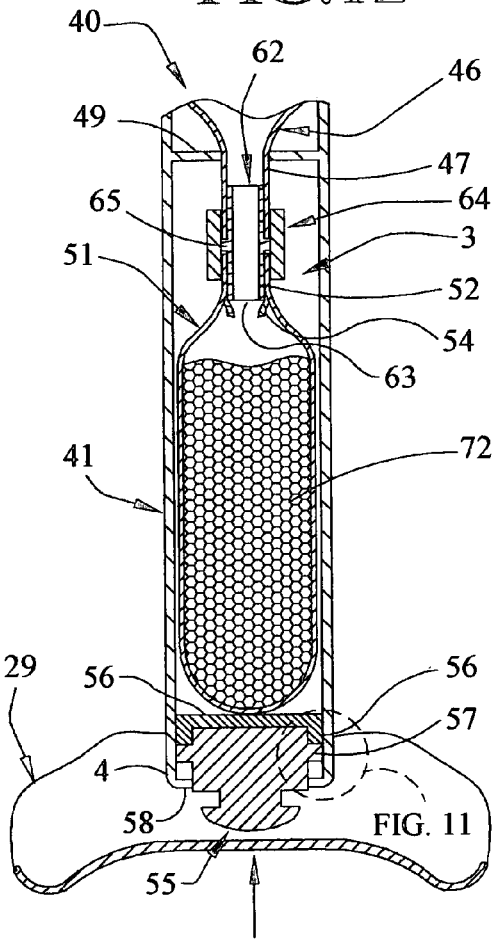
FIG. 10 is a longitudinal sectional view of the middle and lower end of the heating/cooling tube illustrated in FIG. 9, more particularly illustrating actuation of the push-button and mixing of the liquid contents of the two containers responsive to upward movement of the push-button.

A bottom container 51 is also seated in the second cooling/heating tube 41, beneath the top container 46, with a bottom container neck 52 facing upwardly and aligned with or slidably receiving the downwardly-extending top container neck 47, and also typically engaging the gasket seal 64. As illustrated in FIG. 9, a seal 54, which may be either wax, thin plastic, aluminum foil or the like, is compatible with the heating/cooling reagents and is typically provided in the bottom container neck 52 of the bottom container 51 to prevent the top container liquid 50 from flowing into the bottom container liquid 53 located in the bottom container 51. While the top container neck 47 may be smaller than the bottom container neck 52 and slidably fitted therein adjacent to the seal 54, in a preferred arrangement, a tube or straw 62 is inserted in the gasket seal 64 and extends upwardly for fixed attachment inside the top container neck 47. The straw 62 also projects downwardly and slidably into the bottom container neck 52 adjacent to the seat 54, to connect the top container 46 and the bottom container 51, as further illustrated in FIG. 9 of the drawings. The straw 62 connections are typically sealed by the gasket seal 64. The straw edge or lip 63 is positioned adjacent to the seal 54 on the straw 62 at the space 52*a* (FIG. 9) and is sufficiently stiff to penetrate and rupture the seal 54, as hereinafter described. A straw ring 65 is provided on the straw 62 between the extending ends of the top container neck 47 and the bottom container neck 52 to stabilize the straw 62 in place, as illustrated in FIGS. 9 and 10. As further illustrated in FIG. 9, a push-button 55 is slidably seated in the bottom end 4 of the second cooling/heating tube 41 and rests against the inside bottom of the bottle 29, for purposes which will be hereinafter described. A bottom end cap 4*a* is applied in a friction-fit to the bottom end 4 of the second cooling/heating tube 41 to protect the push button 55 prior to removal and insertion of the second cooling/heating tube 41 into the bottle 29 (FIG. 5).

Figure 17:
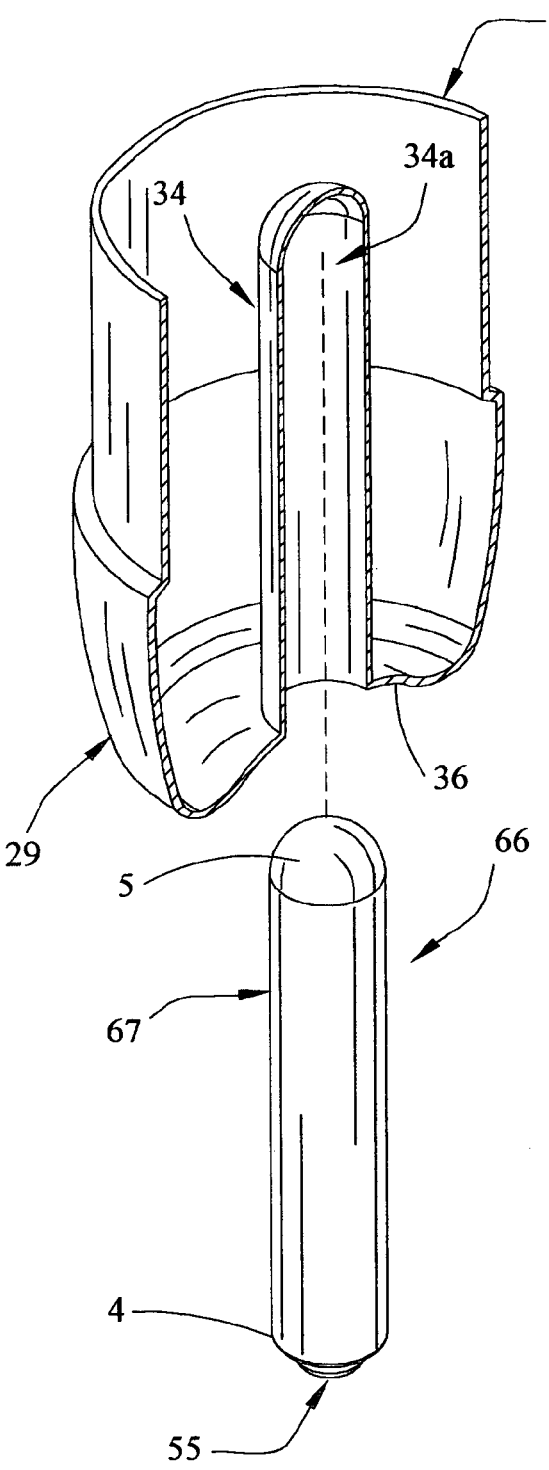
FIG. 17 is a perspective, exploded and sectional view of another embodiment of the invention wherein a cooling/heating tube is inserted in a sleeve or cavity provided in a bottle or can.
Figure 18:
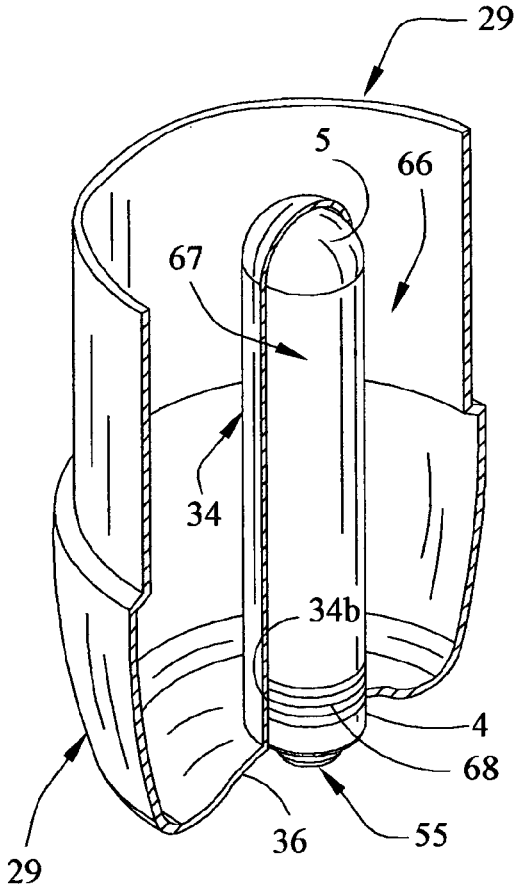
FIG. 18 is a perspective and sectional view of the cooling/heating tube provided with threads and threaded in the sleeve or cavity provided in the bottle or can.

Referring now to FIGS. 5–7, 9–12, 17 and 18 of the drawings, a push-button 55 is slidably captured in the bottom end 4 of both the second cooling/heating tube 41 and a third cooling/heating tube 67 of a third device for cooling or heating liquids 66 (FIGS. 17 and 18) and in the latter case, communicates with a bottle sleeve 34 (FIG. 17) that is molded or otherwise provided in the bottom of the bottle 29. For example, as further illustrated in FIG. 17, a bottle depression 36 typically extends from the side of the bottle 29 to the sleeve interior 34*a* of the bottle sleeve 34 that receives the third cooling/heating tube 67, to facilitate slidable upward movement of the push-button 55, as hereinafter further described. In both embodiments a push-button gasket 56 is typically seated on the push-button 55 adjacent to a round push-button flange 57 (FIGS. 9 and 10) to seat the push-button 55 in the bottom end 4 of the second cooling/heating tube 41 and the third cooling/heating tube 67. One or more, spaced-apart push-button clips 59 are typically molded or otherwise provided in the inside wall of the second cooling/heating 41 and the third cooling/heating tube 67, adjacent to the push-button gasket 56 of the push-button 57 (FIGS. 11 and 12) and are designed to position the push-button 55 in the third cooling/heating tube 67 (as well as the second cooling/heating tube 41) in a desired upwardly-displaced position, as further hereinafter described. When installed, the push-button 55 engages the bottom end of the bottom container 51 in the second cooling/heating tube 41, as further illustrated in FIGS. 9 and 10 of the drawings. The push-button 55 which is mounted in the third cooling/heating tube 67 illustrated in FIGS. 17 and 18 is typically likewise configured and seated therein.

In yet another preferred embodiment of the invention the third device for cooling or heating liquids 66 includes a third cooling/heating tube 67 which is typically provided in a preferred design with tube threads 68 (FIG. 18) that engage corresponding sleeve threads 34*b* provided in the bottle sleeve 34, extending into the interior of the bottle 29 from the bottom end thereof, for accommodating the third cooling/heating tube 67. Alternatively, it will be appreciated from a consideration of FIG. 17 of the drawings, that the third cooling/heating tube 67 can be typically inserted in a bottle sleeve 34 provided in the bottle 29 at the bottom end of the bottle 29 in a friction-fit or maintained therein by other techniques known to those skilled in the art, rather than using the tube threads 68 illustrated in FIG. 18.

Figure 14:
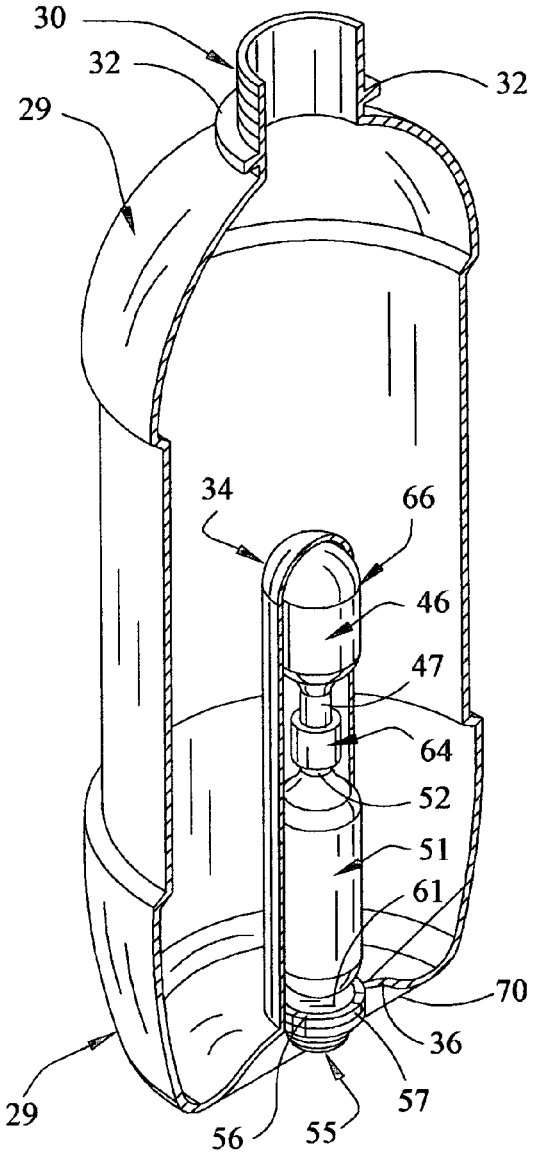
FIG. 14 is a perspective view, partially in section, of another preferred embodiment of the invention wherein the internal components of the cooling/heating tube are positioned in a sleeve or cavity molded or otherwise provided in a bottle or can.
Figure 16:
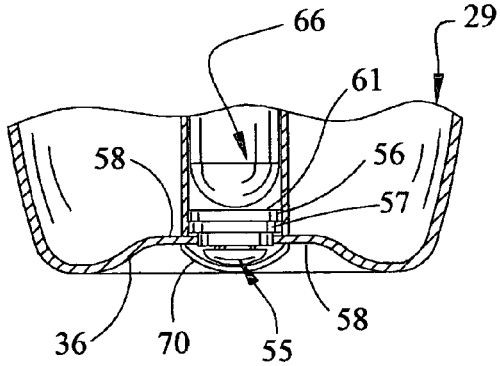
FIG. 16 is a sectional view of the lower end of the tube component embodiment illustrated in FIGS. 14 and 15, with a break-away cap illustrated in place over the push-button element.
Figure 15:
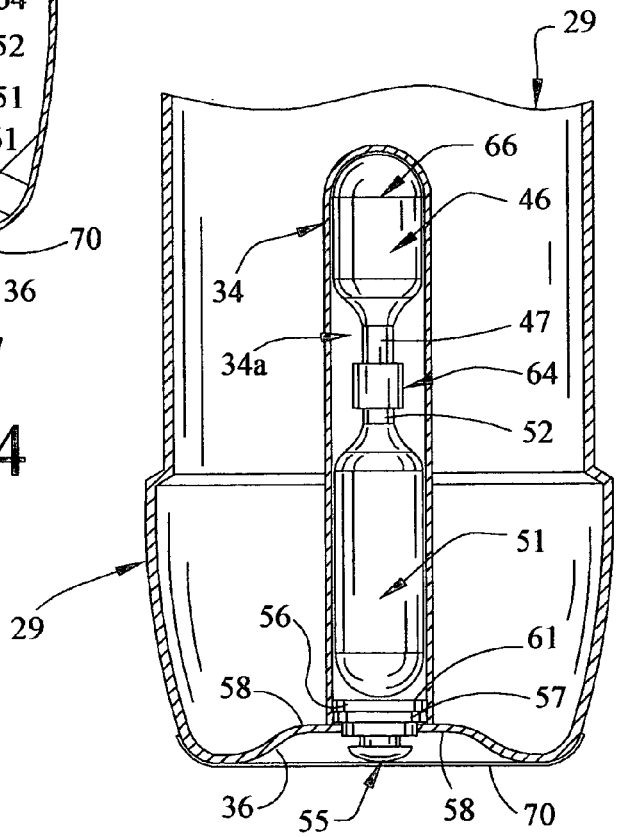
FIG. 15 is a sectional view of the tube component embodiment illustrated in FIG. 14.

As illustrated in FIGS. 14–16 of the drawings, in still another alternative embodiment of the invention, the internal components of the third cooling/heating tube 67 can be manufactured in place inside the bottle sleeve 34 of the bottle 29 or installed therein after manufacture of the bottle 29 and bottle sleeve 34, according to techniques known to those skilled in the art. Accordingly, the top container 46, with a supply of top container liquid 50 and the bottom container 51, with a supply of bottom container liquid 53, connected as described above at a gasket seal 64, can be inserted in or assembled in the sleeve interior 34*a* of the bottle sleeve 34, with the push-button 55 slidably captured in and protruding from the bottom end of the bottle sleeve 34, as illustrated. Accordingly, as illustrated in FIG. 15, the bottle depression 36 in the bottom of the bottle 29 can be shaped to terminate inwardly in a push-button seat ring 58 that engages the push-button flange 57 and captures the push-button 55 in the bottom end of the bottle sleeve 34.

Figure 11:
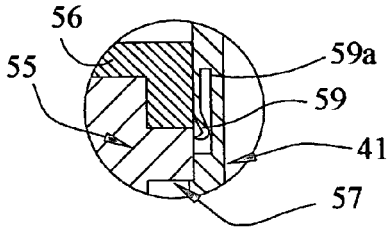
FIG. 11 is a sectional view of the bottom end of the cooling/heating tube and the push-button, more particularly illustrating a push-button clip attached to the push-button and positioned in non-engaging configuration with respect to a recess in the interior cooling/heating tube wall.
Figure 12:
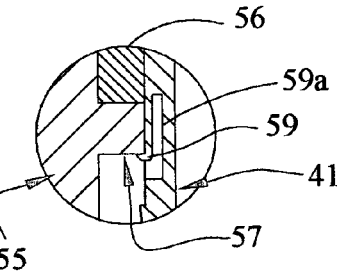
FIG. 12 is a sectional view of the bottom end of the cooling/heating tube and the push-button, more particularly illustrating the push-button clip engaging the recess in the interior cooling/heating tube wall to prevent return of the push-button to its original position in the cooling/heating tube.

In operation, and referring again to FIGS. 5–18 of the drawings, in the embodiments detailed above regarding the second cooling/heating tube 41 and the third cooling/heating tube 67, after the respective cooling or heating tubes (FIGS. 5–13, 17 and 18) or tube components (FIGS. 14–16) are provided with caps or inserted in the corresponding bottle sleeves 34 in the bottle 29, respectively, cooling or heating of the bottle liquid 33 in each case is effected by the following procedure: Under circumstances where the flexible gasket or cap 42 of the second cooling/heating tube 41 is tightly threaded on the bottle neck 30 pressure is exerted on the push button 55, forcing it upwardly. If the bottom end 4 of the third cooling/heating tube 67 is covered by a break-away cap 70, typically as illustrated in FIGS. 15 and 16, the break-away cap 70 is initially removed from the bottom end of the bottle 29, thus exposing the push-button 55. The exposed push-button 55 is then pushed upwardly, thus forcing the bottom container 51 in the third cooling/heating tube 67 upwardly in each case, as illustrated in FIGS. 10–12. Both actions force the seal 54 in the bottom container neck 56 against the straw lip 63 of the straw 62, thus rupturing the seal 54 (FIG. 10) and allowing the top container 50 liquid to flow through the straw 62 and into the bottom container liquid 53 located in the bottom container 51, to define a heating or cooling liquid mixture 72. The push-button 55 is typically maintained in the upward position by operation of the push-button clip or clips 59 that lie adjacent to a corresponding clip seat or seats 59*a*, provided in the internal wall of the respective second and third cooling/heating tubes 41 and 67, (FIGS. 11 and 12), to facilitate a steady flow of top container liquid 50 into the bottom container liquid 53. Mixing of the top container liquid 50 with the bottom container liquid 53 into the liquid mixture 72 (FIG. 10) causes either a heating or cooling effect inside the second cooling/heating tube 41 or the third cooling/heating tube 67, or in the bottle sleeve 34 where no tube is used, as illustrated in FIGS. 14–16, depending upon the properties of the top container liquid 50 and bottom container liquid 53, thus cooling or heating the consumable bottle liquid 33 in the bottle 29. Since the bottle sleeve 34 serves the same purpose as the second and third cooling/heating tubes 41 and 67, pressing the push button 55 operates to commingle the top container liquid 50 and bottom container liquid 53 in the same manner as described above with respect to the devices illustrated in FIGS. 5–13 and 17–18. Typical cooling reagents are ammonium thiocyanate and ammonium hydroxide, although various other cooling/heating reagents can be used, according to the knowledge of those skilled in the art. Drinking of the bottle liquid 33 is then effected by inverting the bottle 29 in conventional fashion to facilitate a flow of bottle liquid 33 from the interior of the bottle 29, through the flow apertures 45 in the gasket cap 43 and the open top end 5, in the case of the second cooling/heating tube 41, or directly through the bottle neck 30 of the bottle 29, in the case of the third cooling/heating tube 67 inserted in the bottle sleeve 34, or the sans tube embodiment illustrated in FIGS. 14–16, all as heretofore described with respect to the first device for cooling or heating liquids 1 illustrated in FIGS. 1–5.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

The invention claimed is:

1. A device for cooling or heating a liquid contained in a bottle or can, said device comprising a tube having an open top and for insertion in the bottle or can; a first container provided in said tube and a first heat-exchanging fluid provided in said first container; a second container provided in said tube beneath said first container and a second heat-exchanging fluid provided in said second container; connecting means fixed to said first container and slidably engaging said second container for connecting said first container to said second container; at least one tube opening provided in said tube for flowing the liquid from the bottle or can, through said tube opening and from said open top when the bottle or can is inverted; a seal provided in said second container between said first heat-exchanging fluid and said second heat-exchanging fluid to prevent commingling of said first heat-exchanging fluid and said second heat-exchanging fluid through said connecting means; and a button slidably disposed in said tube and contacting said second container for displacing said second container in said tube, contacting said seal with said connecting means, rupturing said seal and mixing said first heat-exchanging fluid with said second heat-exchanging fluid in said second container, responsive to application of pressure on said button.

2. The device of claim 1 comprising a cap provided on said tube, said cap adapted for attachment to the bottle or can and a cap opening provided in said cap, said cap opening communicating with said open top of said tube and said at least one tube opening in said tube for flowing the liquid from the bottle or can, through said at least one tube opening and said open top in said tube and through said cap opening in said cap.

3. The device of claim 2 wherein said tube is at least partially submerged in the liquid contained in the bottle or can.

4. The device of claim 3 wherein said connecting means comprises a hollow straw.

5. The device of claim 4 comprising a cap provided on said tube, said cap adapted for attachment to the bottle or can and a cap opening provided in said cap, said cap opening communicating with said open top of said tube and said at least one tube opening in said tube for flowing the liquid from the bottle, through said at least one tube opening and said open top in said tube and through said cap opening in said cap.

6. The device of claim 5 comprising a valve provided in said cap, said valve communicating with said cap opening for selectively opening and closing said cap opening.

7. The device of claim 1 wherein said tube is inserted in an opening provided in the bottom of the bottle or can.

8. The device of claim 7 comprising a cap provided on said tube, said cap adapted for attachment to the bottle and a cap opening provided in said cap, said cap opening communicating with said open top of said tube and said at least one tube opening in said tube for flowing the liquid from the bottle, through said at least one tube opening and said open top in said tube and through said cap opening in said cap.

9. A device for cooling or heating a liquid contained in a bottle, said device comprising a tube having a tube wall and an open top end terminating said tube wall, said tube sized for insertion in the bottle and at least partially submerged in the liquid; a first container provided in said tube, a first container neck downwardly-extending from said first container and a first heat-exchanging fluid provided in said first container; a second container provided in said tube beneath said first container, a second container neck upwardly-extending from said first container and slidably receiving said first container neck and a second heat-exchanging fluid provided in said second container; at least one tube opening provided in said tube wall for flowing the liquid from the bottle or can, through said tube opening and said open top of said tube when the bottle or can is inverted; a seal provided in said second container neck to prevent commingling of said first heat-exchanging fluid and said second heat-exchanging fluid; and a button slidably disposed in said tube and contacting said second container for displacing said second container upwardly in said tube, contacting said seal with said first container neck, rupturing said seal against said first container neck and mixing said first heat-exchanging fluid with said second heat-exchanging fluid in said second container, responsive to application of pressure on said button.

10. The device of claim 9 comprising a valve provided in said cap, said valve communicating with said cap opening for selectively opening and closing said cap opening.

11. The device of claim 9 comprising a straw fixedly engaging said first container neck and slidably engaging said second container neck for contacting and rupturing said seal response to said application of pressure on said button and a straw seal receiving said first container neck and said second container neck for sealing said straw.

12. The device of claim 11 comprising a cap provided on said tube, said cap adapted for attachment to the bottle and a cap opening provided in said cap, said cap opening communicating with said open top of said tube and said at least one tube opening in said tube for flowing the liquid from the bottle, through said at least one tube opening and said open top in said tube and through said cap opening in said cap.

13. The device of claim 12 comprising a valve provided in said cap, said valve communicating with said cap opening for selectively opening and closing said cap opening.

14. A device for cooling or heating a liquid contained in a bottle or can having an internal bottle sleeve, said device comprising a first container provided in said bottle sleeve and a first heat-exchanging fluid provided in said first container; a second container provided in said bottle sleeve beneath said first container and a second heat-exchanging fluid provided in said second container; connecting means fixed to said first container and slidably engaging said second container; a seal provided in said second container between said first heat-exchanging fluid and said second heat-exchanging fluid to prevent commingling of said first heat-exchanging fluid and said second heat-exchanging fluid through said connecting means; and a button slidably disposed in said bottle sleeve and contacting said second container for displacing said second container in said sleeve contacting said seal with said connecting means, rupturing said seal and mixing said first heat-exchanging fluid with said second heat-exchanging fluid in said second container, responsive to application of pressure on said button.

* * * * *